US010159393B2

(12) United States Patent
Conrad

(10) Patent No.: US 10,159,393 B2
(45) Date of Patent: Dec. 25, 2018

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 765 days.

(21) Appl. No.: 13/840,729

(22) Filed: Mar. 15, 2013

(65) Prior Publication Data

US 2014/0259478 A1 Sep. 18, 2014

(51) Int. Cl.
*A47L 11/40* (2006.01)

(52) U.S. Cl.
CPC ..... *A47L 11/4083* (2013.01); *A47L 11/4011* (2013.01); *A47L 11/4088* (2013.01)

(58) Field of Classification Search
CPC ..... A47L 11/4083; A47L 11/4086; A47L 11/4011; A47L 11/4008; A47L 13/225
See application file for complete search history.

(56) References Cited

U.S. PATENT DOCUMENTS 6,131,237 A 10/2000 Kasper et al.
6,253,414 B1 7/2001 Bradd et al.
6,584,990 B2 * 7/2003 Shaw ..... A47L 13/225 134/105
6,898,820 B2 5/2005 Kasper et al.
7,650,667 B2 1/2010 Rosenzweig et al.
7,774,894 B2 * 8/2010 Rippl ..... A47L 11/34 15/118
7,811,022 B2 10/2010 Bobrosky et al.
7,891,047 B2 * 2/2011 Milanese ..... A47L 11/34 15/319
8,205,293 B2 6/2012 Rosenzweig et al.
8,245,351 B2 8/2012 Rosenzweig et al.
8,261,402 B2 9/2012 Rosenzweig et al.
8,353,074 B2 1/2013 Krebs
8,458,850 B2 6/2013 Kasper et al.
8,534,301 B2 9/2013 Nottingham et al.
2002/0096201 A1 7/2002 Shaw
2005/0115014 A1 6/2005 Worwag
2007/0209138 A1 * 9/2007 Tran ..... A47L 5/225 15/320
2008/0034514 A1 2/2008 Rosenzweig et al.
2008/0066789 A1 3/2008 Rosenzweig et al.
2008/0236635 A1 10/2008 Rosenzweig et al.

(Continued)

FOREIGN PATENT DOCUMENTS

WO WO 2013/029040 A1 2/2013
WO WO2013/029040 A1 2/2013

OTHER PUBLICATIONS

US 8,082,621, 12/2011, Rosenzweig et al. (withdrawn)

*Primary Examiner* — Dung Van Nguyen
(74) *Attorney, Agent, or Firm* — Philip C. Mendes da Costa; Bareskin & Parr LLP/S.E.N.C.R.L., s.r.l.

(57) ABSTRACT

A surface cleaning apparatus may include a surface cleaning head including a cleaning pad mount that is configured to receive a cleaning pad and a water distribution system including a first heating unit in fluid communication with a water reservoir and having a water outlet in communication with the cleaning pad mount. The water distribution system may be configured to deliver water to the water outlet as liquid water.

26 Claims, 8 Drawing Sheets

(56) References Cited

U.S. PATENT DOCUMENTS

| | | | | |
|---|---|---|---|---|
| 2009/0000051 | A1 | 1/2009 | Rosenzweig et al. | |
| 2009/0223540 | A1 | 9/2009 | Rosenzweig et al. | |
| 2009/0320231 | A1 | 12/2009 | Rosenzweig et al. | |
| 2010/0024146 | A1 | 2/2010 | Rosenzweig et al. | |
| 2010/0037495 | A1 | 2/2010 | Rosenzweig et al. | |
| 2010/0126533 | A1 | 5/2010 | Nottingham et al. | |
| 2010/0287716 | A1 | 11/2010 | Kasper et al. | |
| 2011/0131753 | A1 | 6/2011 | Krebs | |
| 2012/0137465 | A1 | 6/2012 | Nolan et al. | |
| 2012/0145189 | A1* | 6/2012 | Knopow | A47L 13/16 134/6 |
| 2012/0145191 | A1 | 6/2012 | Williams et al. | |
| 2012/0151703 | A1 | 6/2012 | Chow | |
| 2012/0222227 | A1* | 9/2012 | Johnson | A47L 11/4002 15/105 |
| 2013/0091647 | A1 | 4/2013 | Yuan | |
| 2013/0167319 | A1 | 7/2013 | Tang | |
| 2013/0209075 | A1 | 8/2013 | Ma | |
| 2014/0041147 | A1 | 2/2014 | Pagoria et al. | |

* cited by examiner

SURFACE CLEANING APPARATUS

FIELD

The invention relates generally to a surface cleaning apparatus. An embodiment described herein relates to a heated towel cleaning appliance which is optimized for cleaning smooth floor surfaces, such as linoleum, wood and tile.

BACKGROUND

Throughout the world many homes include smooth flooring surfaces such as linoleum, vinyl, wood and ceramic tile and less carpeting and soft floor coverings. As such, there is an increased requirement for improved methods of cleaning such surfaces. Many steam cleaning appliances have been designed for floor cleaning but their shortcomings in terms of size, weight, reliability and cleaning performance have limited their use.

One problem associated with current steam mops is that the steam alone may be insufficient to provide viable disinfection as the cleaning pad temperature adjacent to the surface being cleaned, and the surface being cleaned do not exceed 85° C. and that such temperatures are only maintained for short periods of time. Furthermore, many stains on floor consist at least partially of organic materials which are therefore not readily dissolved or broken down by water and/or steam. There remains a need for a floor cleaning appliance which can effectively clean and disinfect. A further problem with the use of current steam mops is that many back and forth strokes are required to remove many types of stains.

A further problem with current steam mops is that the rate of steam delivery is fixed while different flooring surfaces and different usage patterns such as the number of cleaning strokes per minute would change the amount of steam and/or cleaning chemicals required to create optimal cleaning.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

Surface cleaning apparatuses can be used to clean floors and other surfaces. In some embodiments, a surface cleaning apparatus can be configured to produce steam and/or heated water and to use the steam and/or heated water to help clean the surface. For example, a surface cleaning apparatus may be configured as a steam cleaning apparatus or mop that includes a reservoir for storing water, a heater or boiler for heating the water and converting at least a portion of the water into steam, and a surface cleaning member (such as a cleaning pad) for contacting the surface. The mop may include a nozzle for directing or spraying the steam and/or water directly onto the surface to be cleaned (for example in front of the surface cleaning member) so that the surface is pre-wetted before being contacted with the surface cleaning member. Alternatively, or in addition, a mop may be configured so that the steam and/or water is supplied to the surface cleaning member, and/or sprayed through the surface cleaning member. In such a configuration, the surface cleaning member can be wetted and/or heated while it is in use, and can be the means by which the surface is wetted.

In accordance with one broad aspect of the teachings described herein, which may be used in combination with any other aspects, a surface cleaning apparatus may include a surface cleaning head including a cleaning pad mount that is configured to receive a cleaning pad and a water distribution system including a first heating unit in fluid communication with a water reservoir and having a water outlet in communication with the cleaning pad mount. The water distribution system may be configured to deliver water to the water outlet as liquid water. Accordingly, instead of providing steam, hot water may be delivered to the cleaning pad. Providing hot water, even water 95-99° C. requires less energy than producing steam. Therefore, if the unit is operated by an on board power source (e.g., batteries), it may operate longer without recharging the on board power source.

Optionally or in addition, the cleaning pad itself may be heated (e.g., the cleaning pad mount may have a heating element therein). An advantage of this design is that, instead of heating the water, which then heats the cleaning pad, the cleaning pad may itself be heated and water, e.g., at room temperature from a reservoir, may be applied to the cleaning pad.

The water distribution system may output water or water and a cleaning agent comprising quaternary ammonium compounds, colloidal silver, thyme oil, cinnamon oil, rosemary oil, sage oil, acetic acid, hydrogen peroxide, tea tree oil, or a combination thereof. The water distribution system outlet may provide fluid to the cleaning pad and/or to the floor.

Similarly, a cleaning agent distribution system may include a cleaning agent outlet directed at least in front of or behind the surface cleaning head. Accordingly, an additional outlet may be configured to provide the cleaning solution to a cleaning pad on the cleaning pad mount and/or the floor.

A controller may be configured to dispense a cleaning agent from the cleaning agent outlet that is at a leading side of the surface cleaning head based on a direction of travel of the surface cleaning head.

The water distribution system may include an outlet directed at least in front of or behind the surface cleaning head and a controller configured to dispense water from the outlet that is at a leading side of the surface cleaning head based on a direction of travel of the surface cleaning head.

The water and/or the cleaning agent distribution system may be configured to deliver a predetermined amount of water for each stroke of the surface cleaning head.

The surface cleaning apparatus may include a detector that receives a signal indicative of the usage of a cleaning pad provided on the cleaning pad mount and a controller may be configured to adjust the amount of water delivered based on a signal from the detector.

The detector may include at least one of a detector to determine the inclination of a handle of the surface cleaning apparatus, the rate of change of the inclination of the handle, the velocity of the surface cleaning head, the rate of acceleration of the surface cleaning head and the conductivity of a cleaning pad.

The surface cleaning apparatus may also include a manually controllable actuator operatively connected to the water distribution system.

The surface cleaning apparatus may also include an automatic dispensing system operatively connected to the water distribution system and a manually controllable dispensing system operatively connected to the water distribution system.

The surface cleaning apparatus may include a cleaning agent distribution system having a cleaning agent outlet and a manually controllable actuator.

The cleaning pad mount may be moveably mounted to the surface cleaning head and the surface cleaning head further may include a drive unit drivingly connected to the cleaning pad mount.

The drive unit may be drivingly connected to the cleaning pad mount to move the cleaning pad mount in a plane that is essentially parallel to a surface to be cleaned.

The drive unit may include at least one motor and at least one offset weight.

The drive unit may include at least one of a solenoid, a sonic transducer, an ultrasonic transducer and a loudspeaker.

At least one of the water reservoir and the heating unit, and preferably both, may be provided in the surface cleaning head.

The surface cleaning head may have a height less than about 4 inches.

At least a portion of the water reservoir, and preferably all, may be transparent.

At least one light to illuminate the water reservoir or to illuminate an area in front of the surface cleaning head, and preferably both, may be provided.

The surface cleaning apparatus may include at least one light to illuminate the water reservoir and a control system to vary the illumination when the water reservoir reaches a low fluid level.

The surface cleaning apparatus may include a low water level detection circuit, the low water level detection circuit comprising a detector monitoring the work performed by the heating unit and an signal member providing a signal when the level of work performed by the heating unit drops below a threshold limit.

The detector may monitor the temperature of the heating unit.

The cleaning pad comprises a hydrophobic material and/or a hydrophilic material.

The surface cleaning apparatus may include a second heating unit thermally connected to the cleaning pad mount.

The first heating unit may be thermally connected to the cleaning pad mount.

In accordance with another broad aspect of the teachings described herein, which may be used in combination with any other aspect, a surface cleaning apparatus may include a surface cleaning head including a cleaning pad mount that is configured to receive a cleaning pad and a water distribution system including a water reservoir and having a water outlet in communication with the cleaning pad mount. The water distribution system may be configured to deliver water to the water outlet as liquid water and a heating unit may be thermally connected to the cleaning pad mount.

The water distribution system may include the heating unit.

The water distribution system may include an additional heating unit.

In accordance with another aspect of the teachings described herein, which may be used in combination with any other aspects, optionally, instead of providing functional components in the housing on the upper portion or other upper portions of the mop, the housing containing the functional components (including, for example, the reservoir, heating apparatus, controllers, etc.) may all be incorporated within the floor nozzle or surface cleaning head. In this configuration, the size of the upper portion may be reduced, and it may lower the center of gravity of the mop. Lowering the center of gravity may make it easier for a user to maneuver the mop. This configuration may also simplify the relationship between the functional components.

It will be appreciated by a person skilled in the art that a mop may embody any one or more of the features contained herein and that the features may be used in any particular combination or sub-combination.

DRAWINGS

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Surface cleaning apparatuses can be used to clean floors and other surfaces. In some embodiments, the surface cleaning apparatus is configured to produce heated water and to use the heated water to help clean the surface. For example, a surface cleaning apparatus may be configured as a cleaning apparatus or mop that includes a reservoir for storing water, a heater or boiler for heating the water and/or the cleaning pad, and a surface cleaning member (such as a cleaning pad) for contacting the surface. The mop may include a nozzle for directing or spraying water directly onto the surface to be cleaned (for example in front of the surface cleaning member) so that the surface is pre-wetted before being contacted with the surface cleaning member. Alternatively, or in addition, a mop may be configured so that water is supplied to the surface cleaning member, and/or sprayed through the surface cleaning member. In such a configuration, the surface cleaning member can be wetted and/or heated while it is in use, and can be the means by which the surface is wetted.

In some embodiments, the surface cleaning apparatus may also be configured to produce steam in addition to hot water or a heated cleaning pad. Accordingly, a heater or boiler may be used to heat the water and convert at least a portion of the water into steam.

Figure 1:
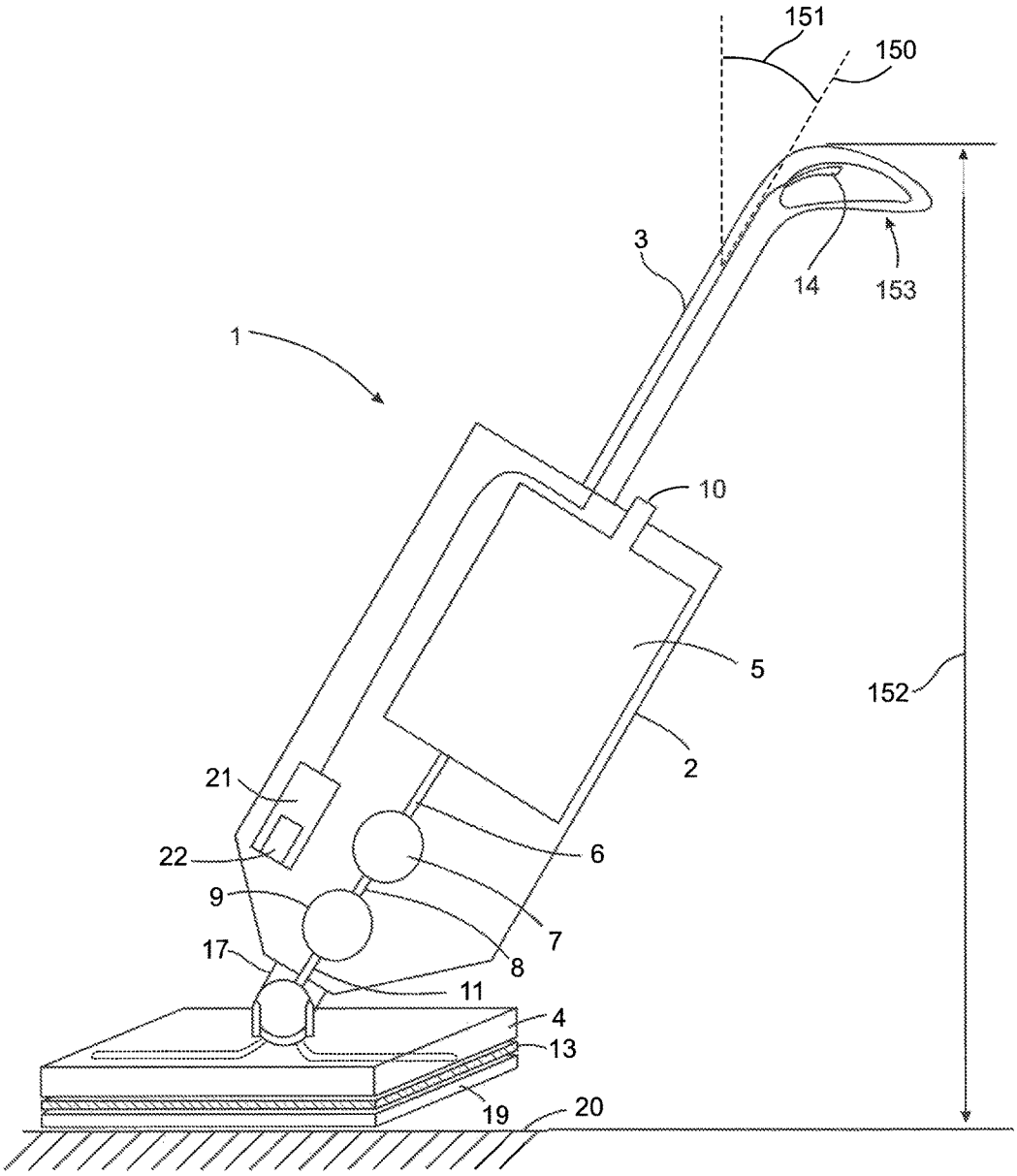
FIG. 1 is a schematic representation of one embodiment of a mop.

In accordance with one embodiment of a surface cleaning apparatus, the surface cleaning apparatus may be configured as a mop that includes an upper portion that is pivotally and drivingly connected to a surface cleaning head. Referring to FIG. 1, a mop 1 is shown. In the illustrated embodiment, the upper portion is provided in the form of a housing 2 and a handle 3 extending upwardly from the housing 2. The upper portion generally extends along an upper axis 150. The housing 2 is pivotally coupled to a surface cleaning head in the form of floor nozzle 4. The housing 2 may be pivotable between a storage position (in which it is positioned generally above the floor nozzle 4) and a use position (FIG. 1) in which the upper axis 2*a* is inclined at an angle 151 relative to a vertical plane. The pivot connection between the housing 2 and floor nozzle 4 can be provided by any suitable mechanism, including, for example a pin joint.

The handle 3 extends generally upwardly from the housing. The length of the handle, and resulting overall height of the mop 1, may be any suitable length and preferably is provided to be long enough to permit a user of the mop 1 to maneuver the floor nozzle 4 on a floor surface 20 which it is desired to clean from a standing position. For example, the combined length of the handle 3 and housing 2 may be selected so that when the mop 1 is in use (as illustrated in FIG. 1) the hand grip portion 153 of the handle 3 is spaced above the surface 20 by an operating height 152 that may be between about 36 inches and about 48 inches or more, and preferably may be between about 40 and about 48 inches. Optionally, the floor nozzle 4 can have a height that is between about 1 inch and about 8 inches, and may be between 2 inches and 6 inches and may be less than about 4 inches. Providing a relatively short floor nozzle 4 may allow the nozzle 4 to fit beneath furniture or other obstacles.

The housing 2 may be configured to house or at least partially contain one or more fluid tanks or reservoirs and optionally may contain one or more boilers, heaters, heat exchangers and other steam producing elements. While illustrated schematically in FIG. 1, the housing 2 may be of any suitable shape, size and configuration and may be made from any suitable materials, including, for example, metal and/or plastic.

In the illustrated embodiment, the housing 2 contains a water distribution system comprising a water reservoir 5 in which water or any suitable aqueous cleaning solution or fluid can be stored. From the reservoir 5, the fluid passes through tube member 6 into an electromechanical fluid pump or electromechanical fluid valve 7 through tube member 8 and into a water boiler 9. The tubes may be of any suitable configuration, and may be flexible or rigid tube members formed from any suitable material (e.g. plastic, metal, etc.). The tubes may be sized to provide a desired flow rate of cleaning fluid to satisfy the demands of the mop 1.

The reservoir 5 may be of any suitable configuration, and may be formed from any suitable material, including, for example metal, plastic and glass. Optionally, the reservoir 5 may be removable from the housing 2. Providing a removable reservoir 5 may allow a user to separate the reservoir from the housing 2 to fill, empty, clean or otherwise handle or manipulate the reservoir 5. If the reservoir 5 is removable, preferably a valve or other flow limiting device may be provided at the interface between reservoir 5 and tube 8 (or anywhere else in the flow path) to prevent cleaning fluid from leaking out of the reservoir when it is detached. An inlet port 10 may be provided toward the top of reservoir 5 for filling the reservoir 5 with a cleaning fluid (water or a cleaning solution). In the illustrated example, the fluid reservoir 5 is filled by means of port 10 with any suitable cleaning fluid.

Optionally, if a cleaning solution is used, the cleaning solution can be selected so that it is preferably an environmentally friendly and safe cleaning and/or disinfecting agent which is not readily denatured by the application of heat. Examples of suitable environmentally friendly and safe cleaning and disinfecting agents include quaternary ammonium compounds, colloidal silver, thyme oil, cinnamon oil, rosemary oil, sage oil, acetic acid, hydrogen peroxide, tea tree oil, or a combination thereof.

If a cleaning solution is used, the cleaning solution may be provided in a separate tank. An advantage of such a design is that the cleaning solution may only be applied when desired by a user. Accordingly, a separate cleaning fluid distribution system may be provided comprising a cleaning fluid reservoir, and suitable piping, valving and outlet (which may be any of those disclosed herein). In some embodiments, the cleaning solution distribution system may use some of the components of the water distribution system.

The electromechanical fluid valve 7 may be any suitable valve and may be configured to supply water to the fluid heating chamber 9 at a prescribed delivery rate. Optionally, the electromechanical fluid valve 7 may be controlled by any suitable controller (for example microprocessor 21) and may be operable to supply the fluid to the fluid heating chamber 9 at a variety of different delivery rates. Alternatively, the fluid from reservoir 5 may be dispensed into the fluid heating chamber 9 at a substantially steady rate under the influence of gravity or by other means as known in the art, without the need for a separate flow regulating or pressurizing means, such as electromechanical fluid valve 7.

In the illustrated embodiment the reservoir 5 is not provided with an internal heating element as is done in some other steam generating systems in mops in the art. Instead, in the illustrated embodiment, the heating means for heating the fluid is provided in the form of a fluid heating chamber 9 that is provided within the housing 2 but is separate from and outside the reservoir 5. The fluid heating chamber 9 may include an electric heating element or heating plate, or any other suitable heating unit. Optionally, the mop may include two or more heating units. In this configuration, the reservoir 5 is not directly heated by the fluid heating chamber 9. Instead, only the volume of fluid that is dispensed from the reservoir 5, for example via electromechanical fluid valve 7, is heated by the fluid heating chamber 9. As the volume of fluid dispensed from the reservoir 5 is generally smaller than the volume of fluid held in reservoir 5 (except when the reservoir 5 is nearly empty), the fluid heating chamber 9 need only heat a relatively small volume of water and is therefore able to bring this fluid to a desired temperature relatively quickly as compared to the time required to heat the entire standing volume of the reservoir 5. One advantage of this strategy may be the fact that controlling of the delivery rate water from the reservoir 5 to the fluid heating chamber 9 may provide substantially direct and relatively immediate control of the heating of the fluid within the fluid heating chamber 9. This may allow a user to selectably generate more or less hot water and/or steam on demand by varying the flow rate of electromechanical fluid valve 7. For example, the flow rate may be selected so that a mixture of heated water and steam is provided downstream from the fluid heating chamber 9. In this configuration, heated water heated water and steam may be dispensed onto the cleaning pad or directly onto the floor.

From the reservoir 5, the fluid flows through a tube member 6, through valve 7 and then through tube member 8 and into the fluid heating chamber 9. From the fluid heating chamber 9, the fluid can flow onto the cleaning pad 12 via tube 11. The fluid heating chamber 9 can be configured to heat the fluid to any desired temperature. Optionally, the fluid heating chamber 9 may include a boiler and may be operable to boil the fluid to produce steam, which may be routed to the pad 12 or directly to the surface 20 being cleaned. Alternatively, the fluid heating chamber 9 need not boil the fluid, and may be configured instead to heat the fluid to provide relatively hot fluid to the pad 12, or directly to the surface 20 being cleaned. Heating the cleaning fluid may help enhance its efficacy. The fluid may be heated to any suitable temperature, and may be heated to temperatures between about 70° C. to about 99° C., between about 75° C. to about 95° C. and preferably to between about 80° C. to about 90° C. In embodiments where steam is not desired, the fluid heating chamber 9 may be configured to heat the cleaning fluid to a temperature that is below the boiling point of the fluid, for example less than 100° C. when using water as the cleaning fluid.

Alternately, or in addition, to heating the fluid in fluid heating chamber 9, an electric heating element plate 13 may be provided in the floor nozzle 4. The heating plate 13 may be positioned adjacent the cleaning pad 12 and is configured to directly heat the pad 12 to a desired temperature. Optionally, the plate 13 can be used to heat the pad 12 to a temperature between about 60° C. and about 99° C., between about 70° C. and about 95° C. and preferably to between about 75° C. and about 85° C.

The cleaning pad 12 may be any suitable type of mop pad or cleaning pad, including, for example a cloth or fabric pad, a sponge, a microfiber pad, a foam or other type of pad member. Optionally, the pad 12 may be formed from natural or synthetic fibres, or a combination thereof. In some embodiments, the cleaning pad 12 may be made from a hydrophobic and/or a hydrophilic material and/or may be treated to provide a desired level of hydrophobicity or hydrophilicity. The cleaning pad 12 may be of any suitable shape, including, for example rectangular, triangular, round, curved or any other shape. The cleaning pad 19 may be of any suitable size. In the illustrated embodiment, the pad 19 is generally rectangular and may be about 5.5 inches by about 10.5 inches. Optionally, the cleaning pad 12 may be removably affixed to the underside of the heating element plate 13 which is on the lower size of the nozzle 4.

The flow of cleaning fluid through valve 7 can be controlled by any suitable controller, like the flow of water described above. In the illustrated example, the microprocessor 21 controls the electromechanical fluid valve 7. Alternatively, a different controller may be used.

The valve 7 can be operated to dispense the cleaning fluid at a fixed rate throughout the operation of mop 1. Alternatively, the valve 7 can be operated to adjust the delivery rate of the cleaning based on the inclination of the mop (e.g. the magnitude of angle 151) or the rate of change of the inclination of the handle. The inclination angle 151 of the mop 1 can be between about 5 degrees to about 90 degrees from the vertical, and may be between about 15 to about 60 degrees from the vertical, and most typically may be between about 20 to about 50 degrees from the vertical. For example, the microprocessor 21 may be configured to control the valve 7 to increase the delivery rate of the cleaning solution when the angle 151 increases. The increases in the rate of delivery of the cleaning solution (and/or steam or water) may be continuously variable and/or proportional to the angle 151. Alternatively, the valve 7 may be positionable in two or more discrete positions so that the delivery rate changes as a step function (between predetermined flow rates) instead of in a continuous manner.

To determine the angle 151 of the upper portion, the mop 1 may include any suitable type of sensor or transducer, including, for example, an accelerometer, an encoder or microswitch in the pivot joint between the housing 2 and the floor nozzle 4, an optical sensor or any other suitable mechanism that can be connected to the microprocessor 21. In the illustrated embodiment accelerometer 22 is provided in the housing 2, in communication with microprocessor 21, and can be used to determine the inclination of the upper portion.

Alternatively, or in addition to the microprocessor 21 can dispense fluid at a delivery rate that is proportional to, or based on, the rate of back and forth motion of the mop 1, which can be electronically sensed by any suitable sensor, including, for example, accelerometer 22.

Optionally, a switch 14 may be provided to enable the user to selectively dispense additional water and/or cleaning fluid (if a separate cleaning fluid distribution system is provided) in order to deal with specific stains or other cleaning issues. In the illustrated embodiment the switch 14 is connected to microcontroller 21, which is operable to dispense the cleaning fluid. Alternatively, or in addition, the switch 14 may be a mechanical trigger or dispensing mechanism that is operable to dispense cleaning fluid without engaging the microprocessor 21.

Optionally, the mop 1 may include a sensor for monitoring the conductivity or resistivity of the cleaning pad 12. The conductivity and/or resistivity of the cleaning pad 12 may vary with its moisture level or fluid saturation. The sensor can be connected to the microprocessor 21, which can be configured to dispense the cleaning fluid if the conductivity falls outside or within a predetermine range. This may allow the mop 1 to automatically dispense additional cleaning fluid when the pad 12 becomes relatively dry, and/or limit dispensing of fluid when the pad 12 is relatively wet.

The cleaning fluid may be delivered to the cleaning pad 12 or directly to surface 20. In the illustrated embodiment, the fluid drips from tube 11, through pivot joint and onto the pad 19. For the illustrated cleaning pad, which is about 5.5 inches×10.5 inches, a cleaning fluid flow rate may be between about 1 to and about 30 ml per minute, and may be between about 3 to 15 ml per minute or between about 6 to 12 ml per minute.

Figure 2:
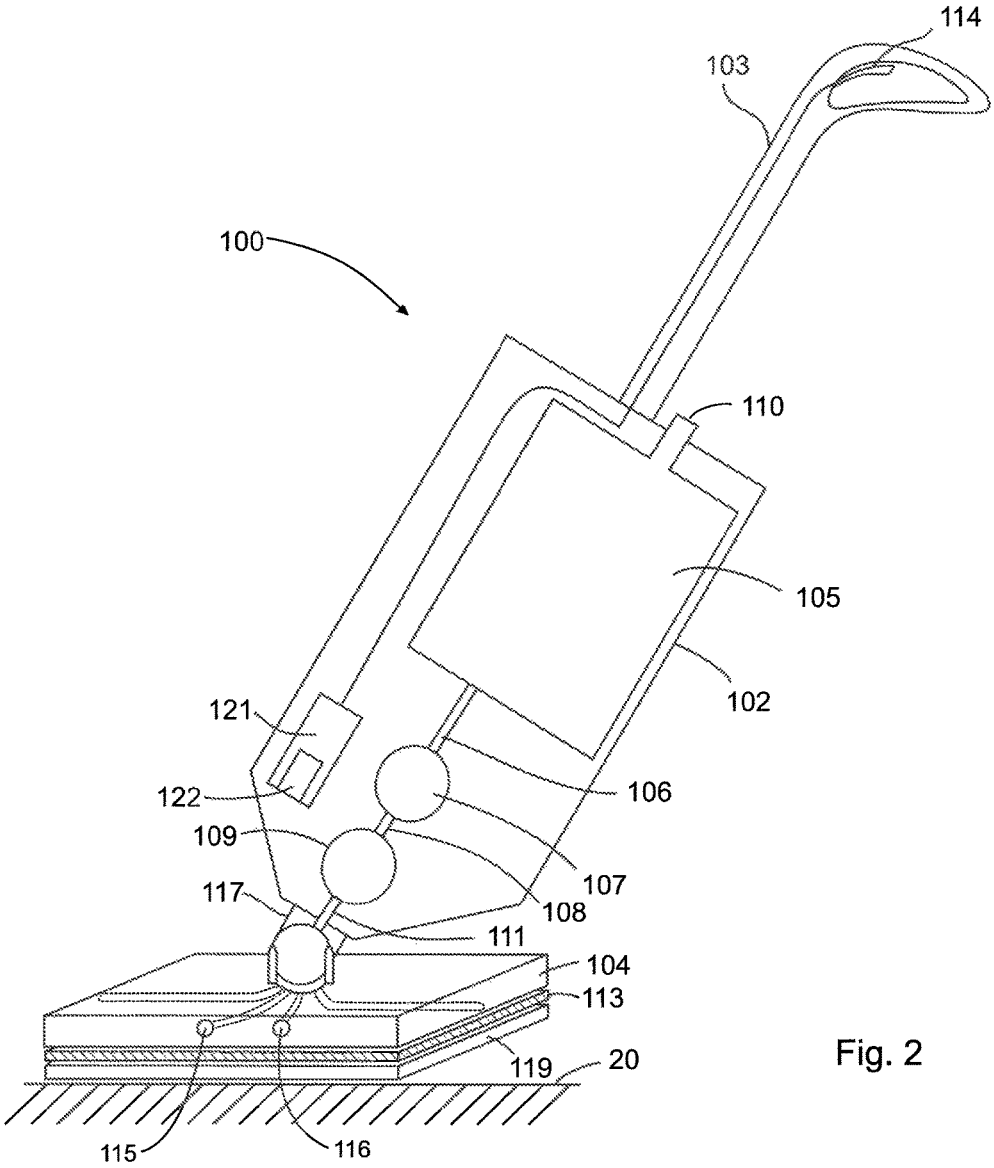
FIG. 2 is a schematic representation an alternative embodiment of a mop.

Optionally, in accordance with one aspect of the teachings herein that may be used in combination with any other aspect, a mop may be configured to dispense the cleaning fluid directly onto the surface 20 being cleaned, instead of, or in addition to, dispensing fluid onto the pad (See for example FIG. 2). In this configuration, the mop may include one or more fluid delivery members, such as a spray jet or other suitable mechanism, for directing cleaning fluid onto the surface 20. The fluid delivery members may be configured to dispense fluid in front of the pad (in the direct of movement of the mop), behind the pad (e.g. to provide fluid when the surface cleaning head is moved in the reverse direction at the end of a cleaning stroke), to the sides of the pad and any combination thereof. Providing fluid in front of and behind the pad may pre-wet portions of the surface that the pad is going to be moved over top of when it is moved in a front-back type pattern. This may also allow a user to dispense fluid onto a target area and allow the fluid to soak or wet the area for a period of time before wiping the area with the cleaning pad.

Referring to FIG. 2, another embodiment of a mop 101 is shown. Mop 101 is generally similar to mop 1, and analogous features are illustrated using like reference characters indexed by 100. In the illustrated embodiment, the mop 101 includes a housing 102 and a handle 103 extending upwardly from the housing 102. The housing 102 contains water or an aqueous cleaning solution in a fluid reservoir 105 from which fluid passes through tube member 106 into an electromechanical fluid pump 107 through tube member 108 and into a fluid heating chamber 109. Preferably, the water or aqueous cleaning solution reservoir 105 is filled through an inlet 110.

In this embodiment, the cleaning fluid passes from the cleaning fluid reservoir 105 through tube member 106 and into the electromechanical fluid pump 107 then through tube member 108 into the fluid heating chamber 109 through tube member 111 and is then sprayed in front of the floor nozzle 104 by means of the spray jets 115 and 116.

The spray jets 115 and 116 may be any suitable fluid dispensing apparatus, and may be configured to eject the fluid as a mist, a stream or in any other suitable mode. Providing multiple jets 115 and 116 may be desirable for a number of reasons, including, for example, to help provide a wider spray pattern and to help provide a desired fluid flow rate.

The cleaning spray from the spray nozzles 115 and 116 may occur under a variety of different conditions, including, for example the spray may be generally continuous when the mop 101 is turned on, or the spray may be produced only then mop 101 is in the working inclination angle and/or in response to back and forth motion which is electronically or mechanically sensed (for example using microprocessor 121), or any combination thereof.

It is understood that the spray means of dispensing water and/or a cleaning fluid as shown in FIG. 2 may be used in conjunction with the means of dispensing the cleaning fluid shown in FIG. 1. For example, additional supply conduits may be provided within the floor nozzle 104 to apply cleaning fluid to the pad 112, independently from the supply of fluids to the spray jets 115 and 116.

In this example, the fluid heating chamber 109 heats water/cleaning fluid to enhance its efficacy. An electric heating element plate 113 is provided to heat the pad 112 separately from the cleaning fluid, and may heat the pad to a temperature between about 60° C. and about 99° C., between about 70 and about 95° C. and preferably between about 75° C. and about 85° C.

The cleaning pad 112 is removably affixed to a cleaning pad mount provided on the underside of the heating element plate 113 which is on the lower size of the nozzle 104. Preferably, the mount is moveable relative to the main body of the floor nozzle 104. The flow of cleaning fluid through electromechanical fluid pump 107 can be controlled by means of a microprocessor 121 which dispenses fluid at a fixed rate in response to the inclination of the mop. Alternatively, the microprocessor 121 can dispense fluid at a rate proportional to the rate of back and forth motion which is electronically sensed by means such as an accelerometer 122. A switch 114 may be provided to enable the user to selectably dispense additional cleaning fluid in order to deal with specific stains or other cleaning issues. Alternatively, the microprocessor 121 can measure the conductivity of the mop pad and dispense fluid to maintain the conductivity within a range which is indicative of the desired moisture level.

Figure 3:
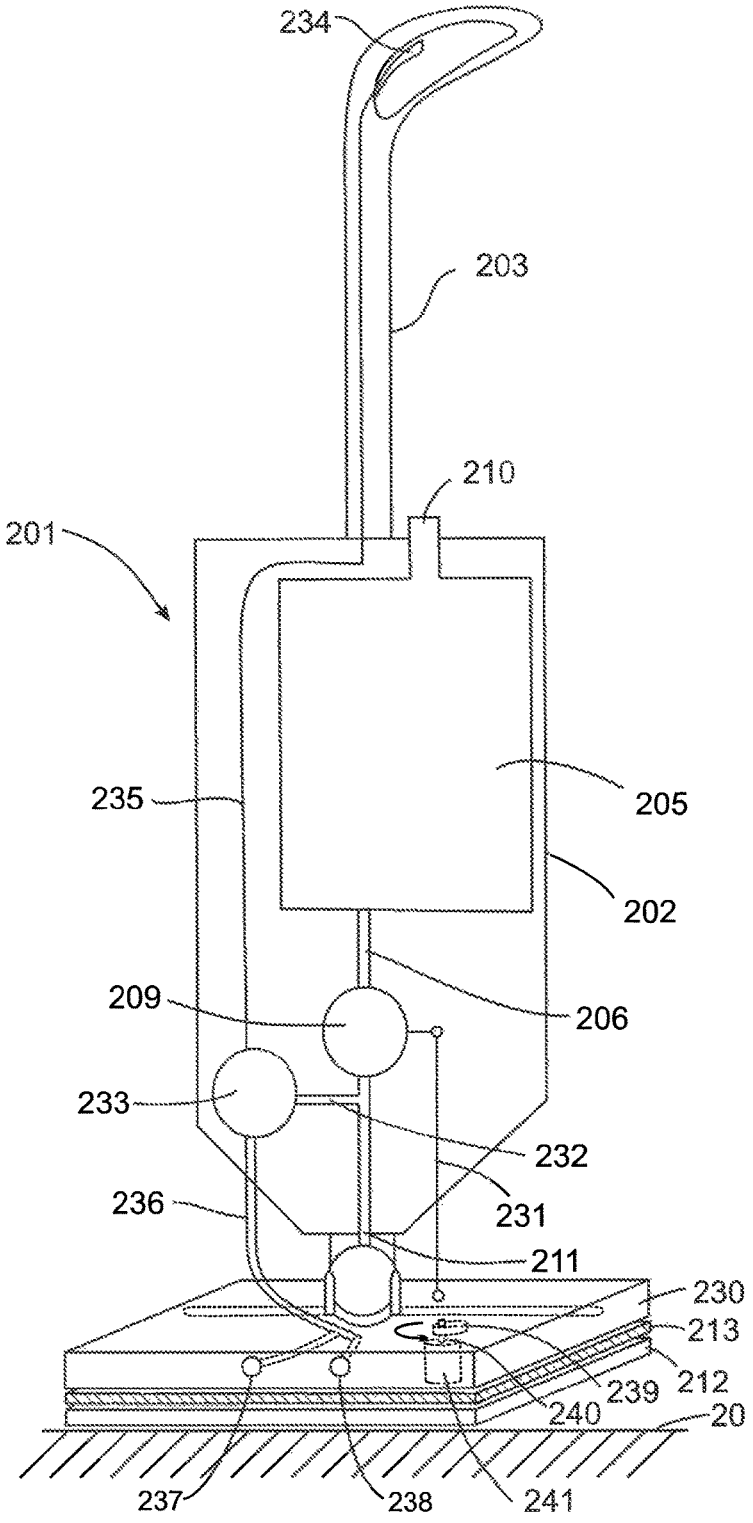
FIG. 3 is a schematic representation of a further alternative embodiment of a mop.

Optionally, as exemplified in FIG. 3, the mop may include a drive unit mechanism for imparting vibrations or other motion to the mount supporting the cleaning pad. Vibrating or oscillating the cleaning pad may help scrub the surface 20 and may help reduce the amount of work required from the user when cleaning the surface 20. Any suitable type of actuator may be used to impart the desired motion and/or vibration to the cleaning pad, or optionally to the entire surface nozzle. Examples of suitable actuators may include, rotating mechanisms, linear-type mechanisms, ultrasonic transducers, loudspeakers, electromechanical mechanisms, mechanical mechanisms, springs, counter weights and the like. This aspect of the teachings described herein may be used in combination with any other aspects.

Referring to FIG. 3, an alternative embodiment of a mop 201 is shown. Mop 201 is generally similar to mop 1, and analogous elements are identified using like reference characters indexed by 200.

In this embodiment, the mop 201 includes a housing 202 and a handle 203 extending upwardly from the housing 202. The housing 202 contains water or an aqueous cleaning solution in a fluid reservoir 205 from which fluid passes through tube member 206 into a mechanical fluid valve 207 through tube member 208 and into a fluid heating chamber 209. Preferably, the water or aqueous cleaning solution reservoir 205 is filled through an inlet 210.

The cleaning fluid passes from the cleaning fluid reservoir 205 through tube member 206 and into the mechanical fluid valve 207 then through tube member 208 into the fluid heating chamber 209 through tube member 211. The fluid can then flow through an opening in a nozzle cover 230 and through an opening in the electric heating element plate 213 and can be dripped onto the cleaning pad 212.

In the illustrated embodiment, the mop includes a mechanical control mechanism for actuating the valve 207. In this configuration, the mechanical fluid valve 207 is opened and the flow of cleaning fluid begins when a mechanical linkage 231 attached to the nozzle cover 230 is triggered. In the illustrated example, the linkage 231 is also connected within the housing 202 and is engaged when the housing 202 is tilted more than 10 degrees from its vertical axis relative to the floor 20, which may represent the working angle for the product.

In addition to dripping cleaning fluid onto the cleaning pad 212, the mop 201 includes spray jets 237 and 238 for spraying cleaning fluid onto the surface 20. In this configuration, an alternative path for flowing cleaning fluid is provided by tube member 232 which leads to a mechanical pump 233 which is activated by means of a linkage 235 extending from trigger mechanism 234. The activation of the mechanical pump 233 forces a volume of heated cleaning fluid through tube member 236 and through the spray jets 237 and 238 located on the front face of the nozzle cover 230. This enables the user to provide additional cleaning fluid to assist in cleaning stains or disinfecting areas or both.

The trigger 234 can be any suitable mechanism, and optionally may be biased toward the off position. The linkage 235 may be a mechanical linkage mechanism, such as a connecting rod, or may be an electromechanical or electrical linkage mechanism (such as a wire or RF transceiver)

In the illustrated configuration, a electromechanical means is provided to induce short stroke mechanical motion of an surface nozzle 204 and cleaning pad 212 in a horizontal or lateral plane that is, preferably, generally parallel to the floor 20. The mechanism for creating planar motion of the nozzle 204 and pad 212 thereon may be any suitable mechanism, including, for example an electric motor. The mechanism may be selectably controlled via a microprocessor, may be controlled by a user or may be "always on" when the mop 201 is powered. Power may be supplied by an external source, or an on board source. Alternatively, instead of an electromechanical mechanism, a non-electric mechanism, such as a spring, movable weight, etc. may be used to impart motion to the pad 212.

The short stroke motion distance may by any suitable distance, and in some embodiments may be between about 0.001 inches to about 2.000 inches, more about 0.005 to about 1.000 inches, and preferably may be between about 0.010 to about 0.250 inches and between about 0.025 to about 0.100 inches.

In the illustrated embodiment, the mechanism for imparting motion of the cleaning pad 212 includes a motor 241 having a shaft 240 and an offset weight 239 mounted on the shaft 240. When the mop 201 is plugged in, or more preferably when the upper portion is tilted into its working position, a motor 241 is energized thereby creating a mechanical motion to assist the cleaning process. The motor 241 and its associated offset weight 239 are provided to induce short stroke mechanical motion of the cleaning pad 212 relative to the floor 20 in one or more axis essentially parallel to the floor 20. Optionally, more than one motor with an offset weight attached may be used and they may operate at different rotational speeds to create a more complex oscillatory motion to optimize the cleaning process.

Figure 4:
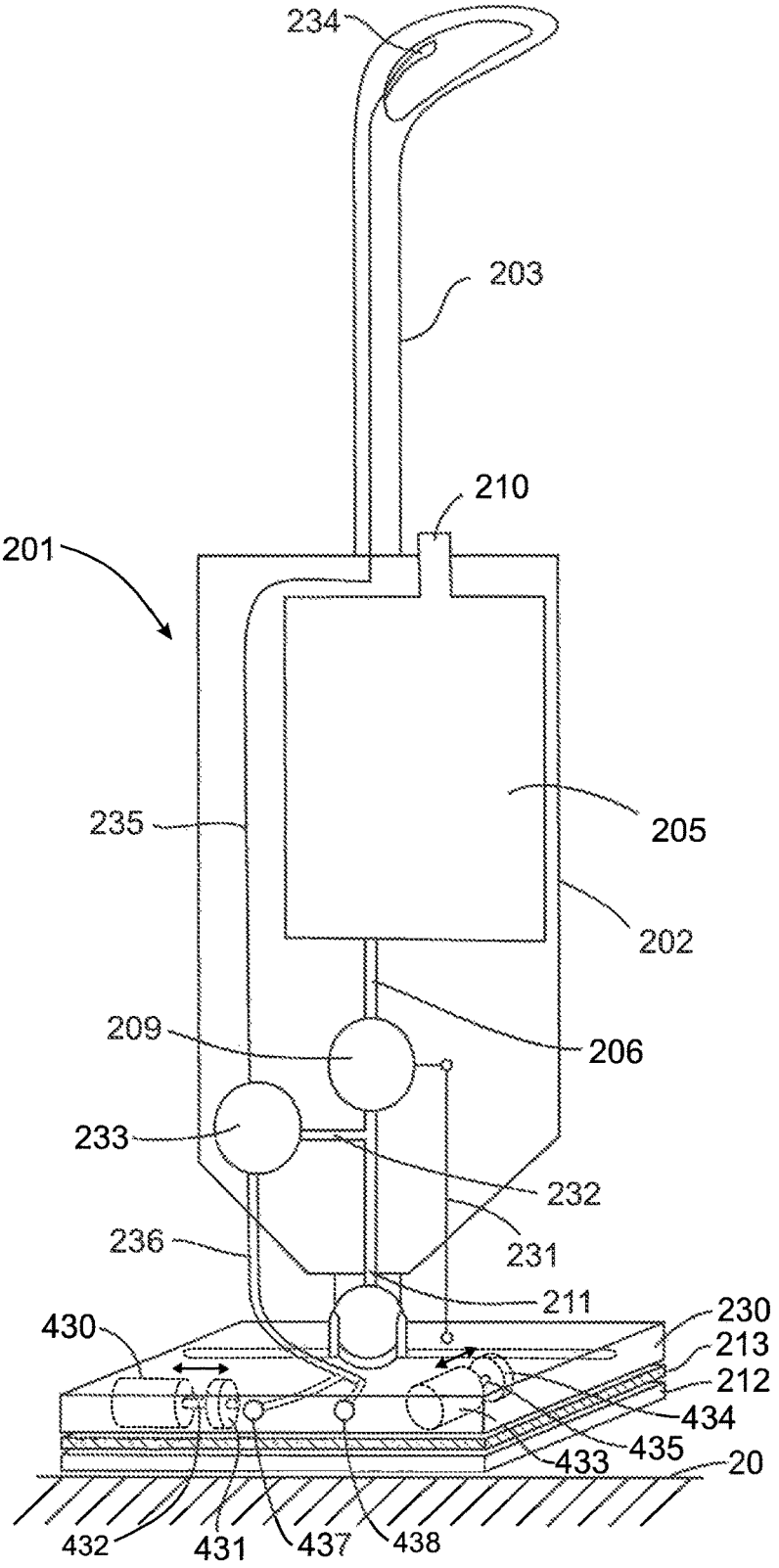
FIG. 4 is a schematic representation of a further embodiment of a mop.

Optionally, instead of a rotating mechanism, the mop may be configured to include one or more linear-type mechanism to induce linear-type movements or vibrations of the cleaning pad 212. Referring to FIG. 4, in another embodiment of the mop 201, a solenoid 430 is mounted within the nozzle cover 230 and has a weight 431 attached to its moving member 432 such that when the solenoid is energized with an AC waveform signal, a linear oscillation is created. The frequency of the AC signal may be varied either periodically or continuously by means of a microcontroller to enhance the mechanical action. Optionally, a second solenoid 433 is mounted within the nozzle cover 230 has a weight 334 attached to its moving member 335 such that when the solenoid is energized with an AC waveform signal, a linear oscillation is created. More than 2 solenoids may also be employed.

The frequency of the AC signal applied to either or both solenoids 330, 333 may be varied either periodically or continuously to enhance the mechanical action. The range of applied frequencies for the solenoids 330, 333 can be any suitable range, including, for example from about 0.01 Hz to about 60 KHz, from about 1 Hz to about 20 KHz and preferably from about 10 Hz to about 30 Hz. Optionally, more than 2 solenoids may be employed.

Alternatively, or in addition any type of actuator may be used in combination with any of the embodiments herein to impart the desired vibration, including, for example a linear motor, a miniature acoustic or ultrasonic transducer, and a loudspeaker may be used in place of the solenoid to create the mechanical motion described.

Figure 5:
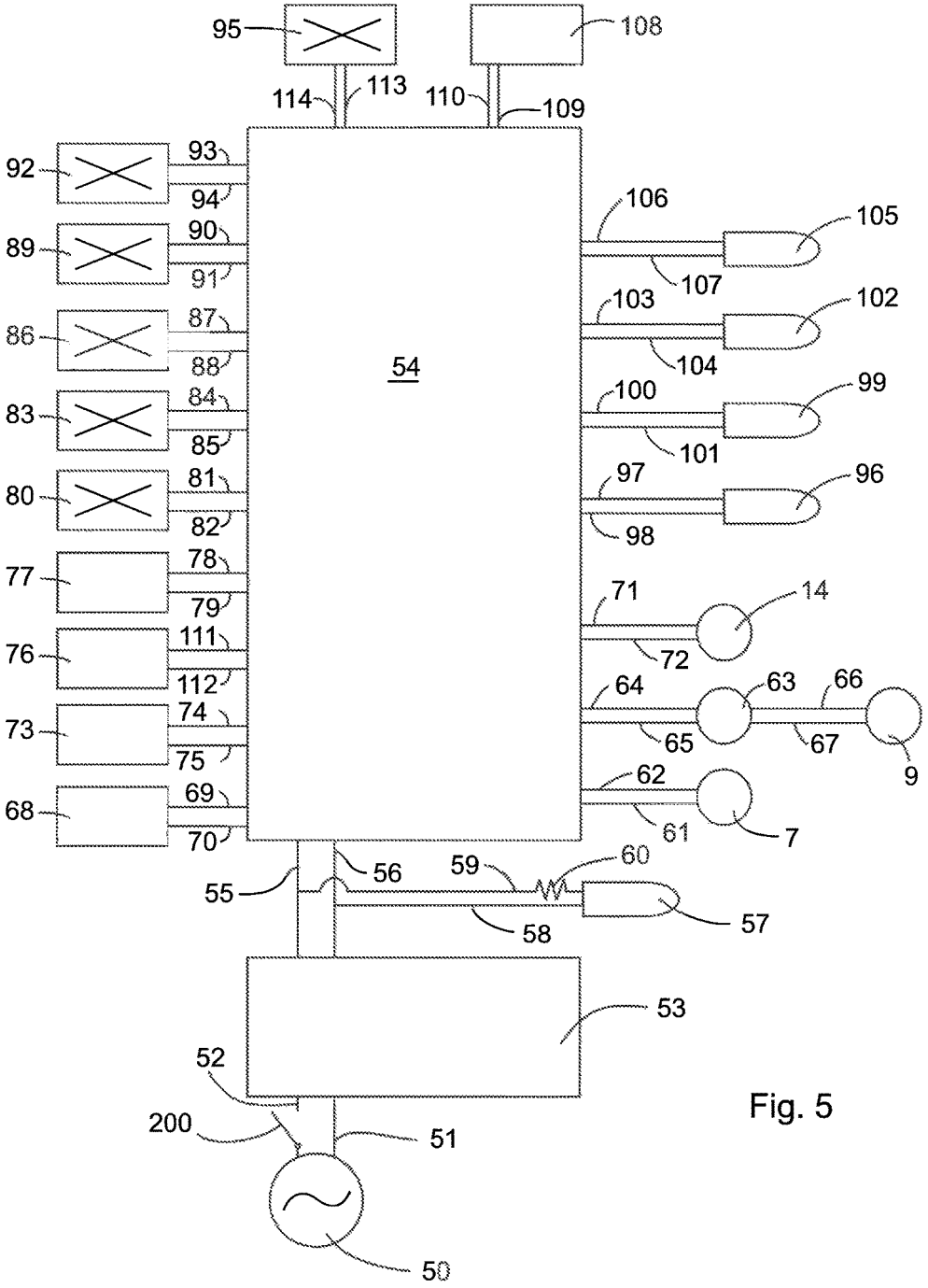
FIG. 5 is a block diagram of one embodiment of control electronics for a mop.

Referring to FIG. 5, a schematic representation of one embodiment of a control system for controlling a mop is shown. The control system includes a power source 50. The power source 50 may be any suitable source, including, for example, an alternating current source or a DC battery.

In the illustrated embodiment, wires 51 and 52 are connected to a power supply 53, which in turn provides power to a microcontroller 54 via wires 55 and 56. The microcontroller 54 may be any suitable microcontroller or other controller apparatus, including, for example, the microcontrollers positioned within the housings of the embodiments of the mops described herein. The microcontroller 54 is configured to receive signals from a plurality of sensors and/or transducers, and is operable to control a variety of output devices, including, for example user feedback and/or information display apparatuses.

In the illustrated embodiment, LED light 57 is connected to wires 55 and 56 by means of wires 58 and 59 which may optionally incorporate resistor 60 if the voltage required by the microcontroller 54 does not match the voltage required by the LED light 57. The LED 57 may be used to indicate to the user that power is being supplied to the appliance. LED 57 may optionally by controlled and or powered by the microcontroller 54 directly.

An electromechanical valve an electromechanical fluid pump or electromechanical fluid valve 7 (see also FIG. 1) is connected to microcontroller 54 by means of wires 61 and 62 and provides the means to control the flow of cleaning fluid (water or cleaning solution) from the reservoir 5 to the fluid heating chamber 9 thereby controlling the rate of cleaning fluid flow.

Optionally, a power relay or field effect transistor 63 may be connected to the microcontroller 54 by means of wires 64 and 65. This may provide a means of turning on and off the power to the fluid heating chamber 9 (FIG. 1) through wires 66 and 67. The power to the fluid heating chamber 9 can be controlled using any suitable criteria, including, for example, being turned on and off based on an algorithm to maintain a specified temperature range as measured by a fluid heading chamber temperature sensor 68 which is connected to the microcontroller 54 by means of wires 69 and 70.

Optionally, a thermo-mechanical relay device may be used to directly control the power to the fluid heating chamber 9 in response to the temperature of the boiler. One advantage of a microcontroller based control system may be that the temperature hysteresis exhibited by some typical thermo-mechanical devices may be avoided and more precise control may be achieved.

Optionally, an auxiliary electromechanical valve 14 (e.g., as a backup for the water distribution system or the optional cleaning solution distribution system) may be provided in some embodiments, and may be connected to microcontroller 54 by means of wires 71 and 72.

In the illustrated embodiment, a mechanical switch to indicate that the mop is in the working position, for example a tilt switch or inclination sensor 73, is optionally connected to the microcontroller 54 by means of wires 74 and 75.

An accelerometer 76 is optionally connected to the microcontroller 54 by means of wires 111 and 112.

Optionally, a software algorithm can be used to control the rate of flow of fluid through the through the electromechanical fluid pump or electromechanical fluid valves 7 and 14 in response to a input signal from one or more of the sensors, such as mechanical switch, a tilt switch or inclination sensor 73 or the accelerometer 76 to indicate that the mop is in the working position. When the mop is in the working position as indicated by sensors and/or the mop is being moved back and forth as indicated by sensor 76, the microcontroller may cause the electromechanical fluid pump or electromechanical fluid valve 7 to dispense the cleaning fluid. The delivery rate may be any desired rate. For example, a push/pull rate of about 45-60 strokes per minute for a the 5.5 inches×10.5 inches cleaning pad described with reference to FIG. 1, a cleaning fluid flow rate of between about 1 to 30 ml per minute may be preferred, and a flow rate of between about 3 to 15 ml per minute may be more preferred, and a flow rate of between about 6 to 12 ml per minute may be most preferred. Alternatively, if the push/pull rate is between 30-44 strokes per minute, the preferred cleaning fluid delivery rate may be reduced by an appropriate amount, such as by about 20-25%. If the push/pull rate is between 61 to 75 strokes per minute, the preferred cleaning fluid delivery rate may be increased by an appropriate amount, such as about 15-20%.

Referring again to FIG. 5, in the illustrated embodiment, a series of user controlled switches 80, 83, 86, 89, 92, and 95 are connected to the microcontroller 54 by means of wires 81 and 82, 84 and 85, and 87 and 88, 90 and 91, and 93 and 94 respectively. The switches may be any suitable type of switch that can be incorporated onto the mop.

Switches 80 and 83 may provide the user with a means of increasing or decreasing the flow rate of fluid through the electromechanical fluid pump or electromechanical fluid valve 7 thereby increasing or decreasing the cleaning fluid flow. Switch 86 may provide a means of delivering a "burst of cleaning fluid" by delivering about 2-6 ml of fluid to the fluid heating chamber 9 (or any other suitable quantity) over 2-3 seconds in addition to the normal flow rate of cleaning fluid.

Switch 86 may provide the user with a means of delivering a bust of cleaning fluid by delivering 2-6 ml of cleaning fluid to either the cleaning pad or onto the surface adjacent the cleaning pad, or both.

Switches 89 and 92 enable a user to increase or decrease the oscillating frequency of the motor, solenoid, speaker, ultrasonic transducer or other such actuators provided to create a short mechanical stroke or vibrations in the cleaning pad to assist the cleaning process. Switch 95 enables the user to turn on and off the transducer that is used to create a snort mechanical stroke to assist the cleaning process.

Optionally, a series of lights, e.g., LED lights, 96, 99, 102, and 105 may be connected to the microcontroller 54 by means of wires 97 and 98, 100 and 101, 103 and 104, and 106 and 107 respectively.

LED light 96 may be a headlight for the mop, and may be provided on the floor nozzle or any other suitable location (e.g. the housing).

LED light 99 may be an auxiliary headlight to add additional brightness at the floor when cleaning fluid is sprayed to provide the user with visual feedback of an action.

LED 102 may provide the user with feedback when the water tank is empty which is sensed by the fluid heating chamber temperature sensor 68. For example, if the fluid heating chamber temperature does not decrease in response to the microcontroller delivering cleaning fluid by activating the electromechanical fluid pump or electromechanical fluid valves 7 the temperature sensor 68 may indicate that cleaning fluid is not available. Alternatively, a float switch in the reservoir can act as the sensor for the status of the water level. Alternatively, the reservoir or a portion thereof can be made transparent so that the user can see the water fill level.

LED 105 may provide the user with feedback that short stroke actuator is on or off.

A master on/off switch 200 is provided in the wire 52 to cut power to the power supply 53.

In accordance with another aspect of the teachings described herein, which may be used in combination with any other aspects, optionally, instead of providing functional components in the housing on the upper portion or other upper portions of the mop, the housing containing some, and preferably all, of the functional components (including, for example, the reservoir, heating apparatus, controllers, etc.) may all be incorporated within the floor nozzle or surface cleaning head. In this configuration, the size of the upper portion may be reduced, and it may lower the centre of gravity of the mop. Lowering the centre of gravity may make it easier for a user to maneuver the mop. This configuration may also simplify the relationship between the functional components.

Figure 6:
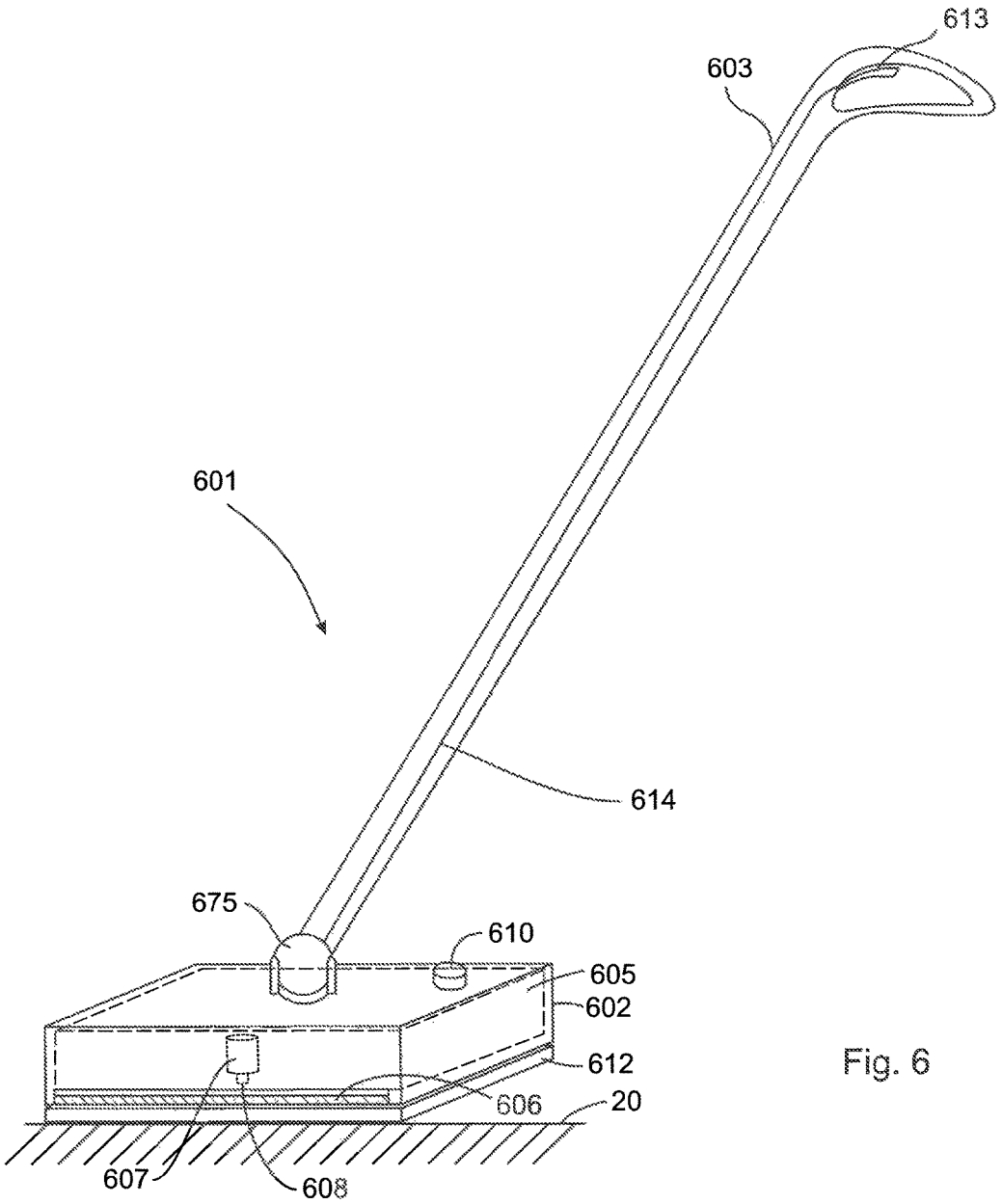
FIG. 6 is a schematic representation of a further embodiment of a mop.

Referring to FIG. 6, a mop 601 is shown. The mop 601 includes a housing 602 and a push handle 603 which incorporates an angled rotating swivel connection 675. The connection 675 may include any suitable mechanism, and preferably enables the nozzle 604 to be steered when the push handle 602 is rotated. Preferably, the push handle 603 is provided to be long enough to permit a user of the mop 601 to maneuver the housing 602 which, in this embodiment, is also the member to which the floor engaging member, e.g. the cleaning pad 612, is attached. For example, the push handle 602 may extend at least about 3 feet above the floor surface, and preferably 40 to 48 inches above the floor surface.

In this embodiment, the housing 602 is provided within the floor nozzle 604 and houses a means for heating water or an aqueous cleaning solution and a means of controlling the dispensing of this cleaning solution to the floor. In the illustrated configuration, the housing 602 contains water or an aqueous cleaning solution in a fluid reservoir 605 which is comprised of an upper plastic housing and a lower metallic heating element plate 606. The heating plate 606 may be any suitable type of heater, including, for example a calrod heating element, a thick film resister, or another resistive heating means.

Optionally, the water or aqueous cleaning solution reservoir 605 may be filled by means of port 610 with any known cleaning solution, but preferably with an environmentally friendly and safe cleaning and disinfecting agent which is not readily denatured by the application of heat. Examples of such environmentally friendly and safe cleaning and disinfecting agents include quaternary ammonium compounds, colloidal silver, thyme oil, cinnamon oil, rosemary oil, sage oil, acetic acid, hydrogen peroxide, tea tree oil, or a combination thereof.

Flow from the reservoir 605 onto the pad 612 may be controlled by any suitable mechanism, including a valve and/or a regulator. In the illustrated embodiment, a mechanical or electromechanical valve 607 located within or adjacent to the fluid reservoir 605 provides a means of passing controlled volumes of heated aqueous cleaning fluid from within the fluid reservoir 605, through a penetration 608 in the lower metallic heating plate 606, and onto the cleaning pad 612. It is understood that more than one penetration 608 and/or more than one valve 607 may be provided to achieve even wetting of the cleaning pad 612.

Optionally, the mop 601 can be configured so that delivery of fluid from the reservoir 605 to the pad 612 can be automatically controlled based on the use of the mop 601. For example, in the illustrated embodiment, a simple mechanical lever or an electrical switch 611 is mounted to the an angled rotating swivel connection 675 provides a mechanical or electrical signal every time that the mop is pushed or pulled which opens the valve 607 so as to dispense a preset amount of fluid. In the illustrated embodiment of the mop 601, in which wherein the cleaning pad is about 5.5 inches×10.5 inches, the valve 607 will preferably dispense 0.01 to 1 ml per push or pull cycle, more preferably dispense 0.03 to 0.3 ml per push or pull cycle, and most preferably dispense 0.04 to 0.08 ml per push or pull cycle. An optional trigger 613 connected by mechanism 614 to the simple mechanical lever or an electrical switch 611 is also shown. The trigger 613 allows as user to provide additional cleaning fluid on demand as required.

In the illustrated embodiment, the heating plate 606 heats all of the cleaning fluid contained in the reservoir 605. Optionally, the heating plate 606 may be integral with and/or form one of the sidewalls of the reservoir 605. Alternatively, the heating plate 606 may be separate from the sidewalls of the reservoir, and may be positioned inside the reservoir 605 or external the reservoir 605.

Optionally, mop can include a thermostat or other control mechanism to control the operation of heating plate 606 and the temperature of the cleaning fluid in the reservoir 605. Providing a temperature control mechanism may help prevent under or over heating of the cleaning fluid, and may help prevent unwanted boiling of the cleaning fluid. In the illustrated embodiment, a thermo-mechanical switch acts as a thermostat and maintains the temperature of the aqueous cleaning solution within the fluid reservoir between of 60 C to 99 C, more preferably 70 C to 97 C and most preferably 85 C to 95 C.

In accordance with another aspect of the teachings described herein, which may be used in combination with any other aspects, the reservoir 605 may be of any suitable shape and/or capacity. Increasing the capacity of the reservoir 605 may allow the mop 601 to be used longer between fill-ups. Alternatively, reducing the capacity of the reservoir 605 may reduce the overall size and weight of the mop 601. Preferably, a capacity can be selected that provides a useful amount of cleaning time, without being too heavy or cumbersome. Also, the fluid in the reservoir 605 may act as a thermal storage device, which may retain its heat after the heating plate 606 has been turned off. This may allow the cleaning fluid to remain at a useful temperature when the heating plate 606 is turned off and/or when the mop is not plugged in to an external power source. Optionally, the reservoir 605, and/or other portions of the surface nozzle 604, may be insulated to help inhibit heat escaping from the cleaning fluid. Alternatively, a phase change material such as a paraffin wax or a low melting temperature metal may be incorporated into the fluid reservoir 605 as a means of storing heat. However, an aqueous solution of the cleaning fluid provides an acceptable energy storage density and a relatively low cost means of energy storage.

In the illustrated embodiment, the reservoir 605 is configured to have a volume of about 115 cubic inches, which is a weight of approximately 4.14 pounds of cleaning fluid. When in use, the pad 612, which is about 5.5 inches×10.5 inches, may typically lose heat energy to the floor at a rate of 460 btu/hr at 85 C (176 F) for a wooden floor, and 690 btu/hr at 85 C (185 F) for a ceramic floor. If the fluid in the fluid reservoir remains above 80 C (176 F) the cleaning and disinfection efficacy of the cleaning mop is likely to remain desirable. In this configuration, if the reservoir 605 is filled with fluid, and plugged in for 3 to 5 minutes to heat the cleaning solution to about 95 C (203 F), the mop can then be unplugged and used in a cordless manner for between about 10 to about 15 minutes depending upon the type of flooring being cleaned. This configuration may allow a user to plug in the mop 601 in order to initially heat up the cleaning fluid, and then detach the electrical cord and use the mop without being tethered to the wall.

Optionally, in accordance with one aspect of the teachings herein that may be combined with any other aspects, the mop 601 may be configured to include an actuator for inducing vibrations and/or short stroke motion in the floor nozzle 604. The actuators used may be generally similar to the actuators described herein. If actuators are included within the floor nozzle 604, the reservoir 605 may be shaped to accommodate the placement of the actuators.

Figure 7:
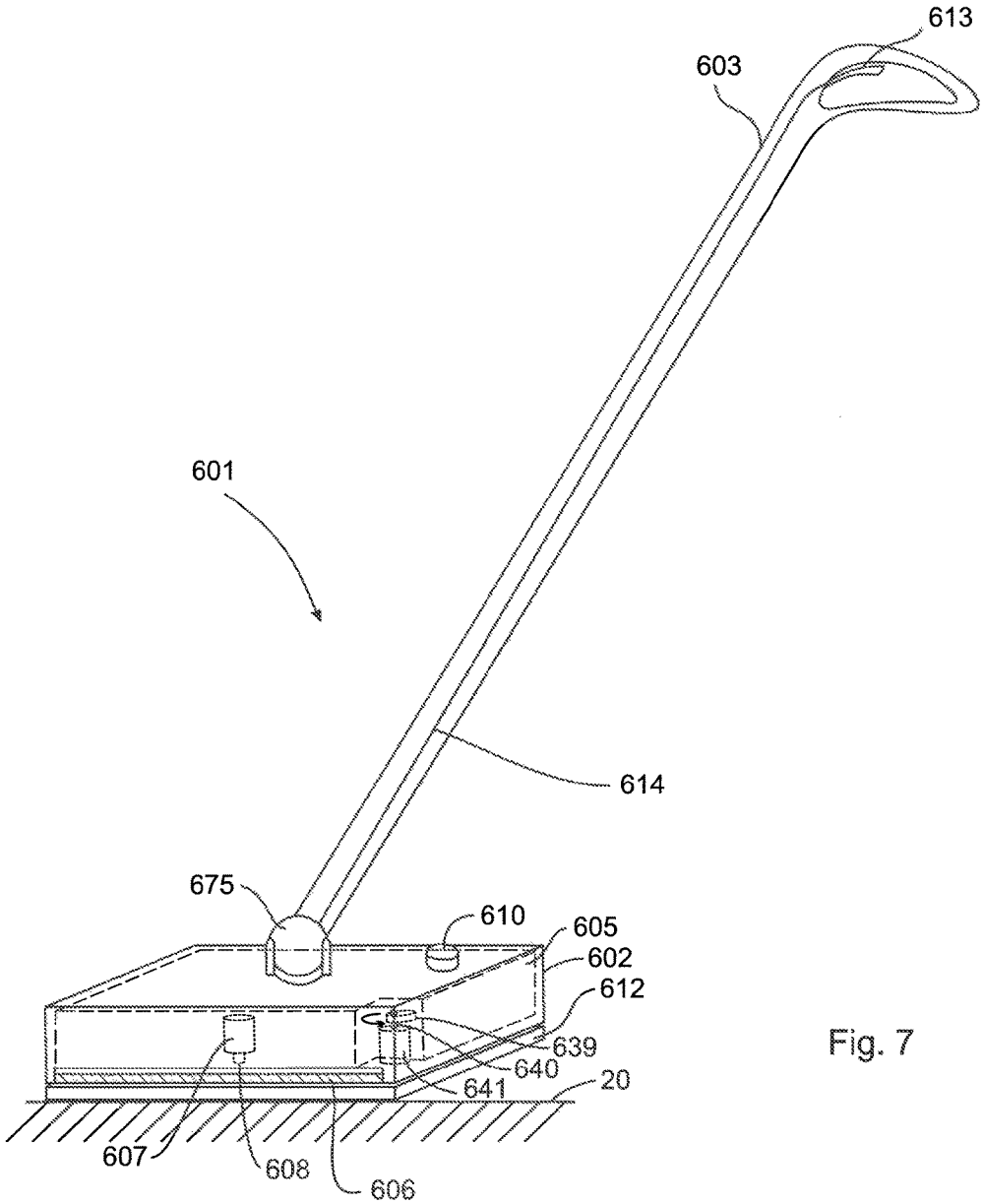
FIG. 7 is an alternative configuration of the mop of FIG. 6.

Referring to FIG. 7, a modified version of mop 601 is shown in which the reservoir 605 is shaped to accommodate an actuator including motor 641 with rotating shaft 640 and an off-set weight 639. This rotating-type actuator can introduce vibrations within the floor nozzle 604. In this embodiment, the reservoir 605 includes a notch or cut-out area to accommodate the actuator.

Figure 8:
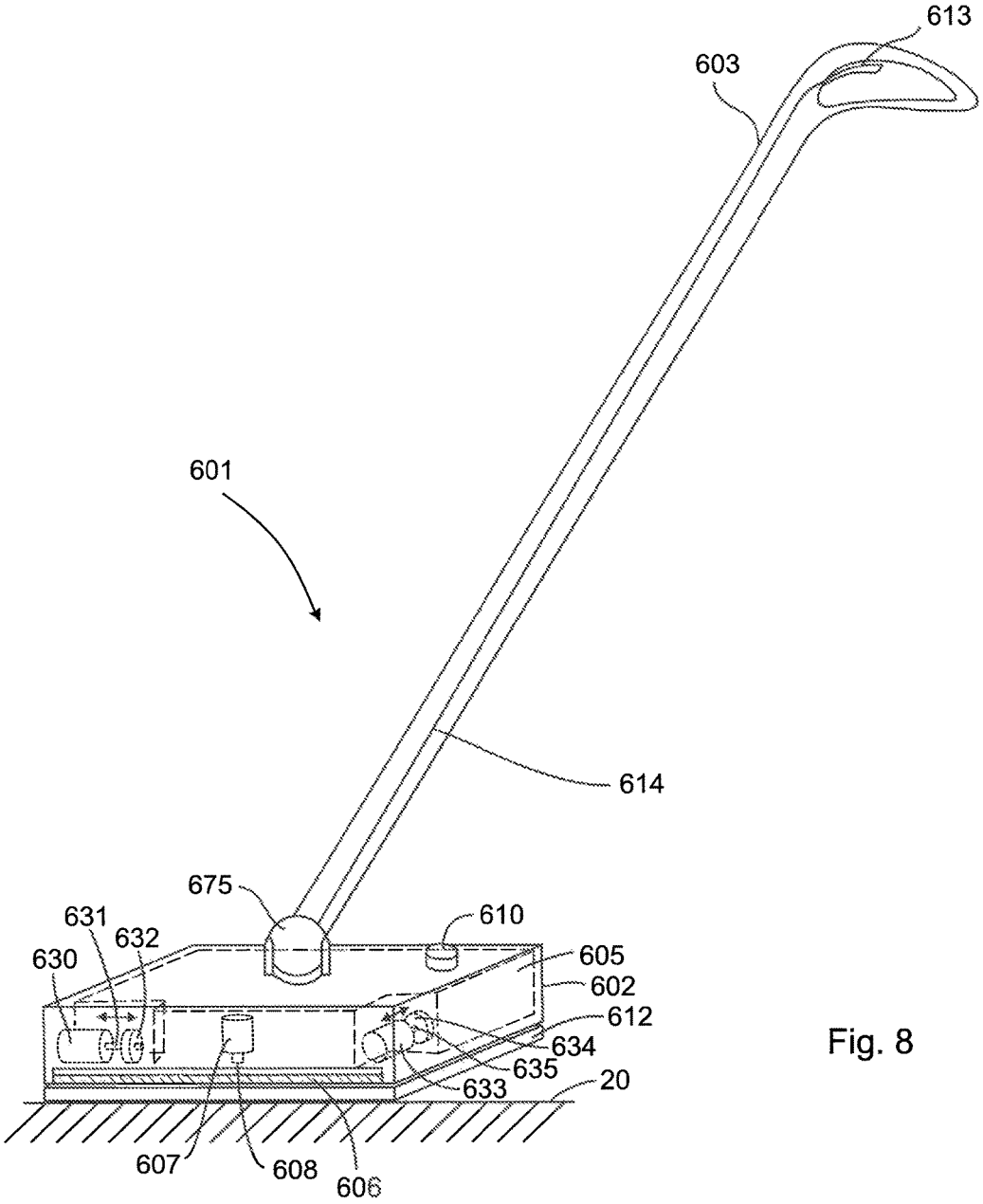
FIG. 8 is another alternative configuration of the mop of FIG. 6.

Referring to FIG. 8, in another modified version of mop 601, the reservoir is shaped to accommodate two, linear type actuators for creating motion in the floor nozzle 604. In this embodiment, a solenoid 630 is mounted within the nozzle 604 and has a weight 631 attached to its moving member 632 such that when the solenoid is energized with an AC waveform signal, a linear oscillation is created. The frequency of the AC signal may be varied either periodically or continuously by means of a microcontroller to enhance the mechanical action. Optionally, a second solenoid 633 is mounted within the nozzle 604 has a weight 634 attached to its moving member 635 such that when the solenoid is energized with an AC waveform signal, a linear oscillation is created. More than 2 solenoids may also be employed.

The frequency of the AC signal applied to either or both solenoids 630, 633 may be varied either periodically or continuously to enhance the mechanical action. The range of applied frequencies for the solenoids 630, 633 can be any suitable range, including, for example from about 0.01 Hz to about 60 KHz, from about 1 Hz to about 20 KHz and preferably from about 10 Hz to about 30 Hz, Optionally, more than 2 solenoids may be employed.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow. What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

a) a surface cleaning head including a cleaning pad mount that is configured to receive a cleaning pad;

b) a water distribution system including a first heating unit in fluid communication with a water reservoir, the water distribution system having a water outlet in communication with the cleaning pad mount, wherein the first heating unit is located along a fluid flow path from the water reservoir to the water outlet at a location upstream of the water outlet, and the water distribution system is configured to deliver water to the water outlet as liquid water; and, c) a detector that receives a signal indicative of the usage of a cleaning pad provided on the cleaning pad mount and a controller configured to adjust the amount of water delivered based on a signal from the detector.

2. The surface cleaning apparatus of claim 1 wherein the detector comprises at least one of a detector to determine the inclination of a handle of the surface cleaning apparatus, the rate of change of the inclination of the handle, the velocity of the surface cleaning head, the rate of acceleration of the surface cleaning head and the conductivity of a cleaning pad.

3. The surface cleaning apparatus of claim 1 further comprising a manually controllable actuator operatively connected to the water distribution system.

4. The surface cleaning apparatus of claim 1 further comprising an automatic dispensing system operatively connected to the water distribution system and a manually controllable dispensing system operatively connected to the water distribution system.

5. The surface cleaning apparatus of claim 4 further comprising a cleaning agent distribution system having a cleaning agent outlet and a manually controllable actuator.

6. A surface cleaning apparatus comprising:

a) a surface cleaning head including a cleaning pad mount that is configured to receive a cleaning pad;

b) a water distribution system including a first heating unit in fluid communication with a water reservoir, the water distribution system having a water outlet in communication with the cleaning pad mount, wherein the first heating unit is located along a fluid flow path from the water reservoir to the water outlet at a location upstream of the water outlet, and the water distribution system is configured to deliver water to the water outlet as liquid water; and, c) a low water level detection circuit, the low water level detection circuit comprising a detector monitoring the work performed by the heating unit and an signal member providing a signal when the level of work performed by the heating unit drops below a threshold limit.

7. The surface cleaning apparatus of claim 6 wherein the water distribution system outputs water and cleaning agent comprising quaternary ammonium compounds, colloidal silver, thyme oil, cinnamon oil, rosemary oil, sage oil, acetic acid, hydrogen peroxide, tea tree oil, or a combination thereof.

8. The surface cleaning apparatus of claim 6 wherein the dispensing outlet or an additional outlet is configured to provide the cleaning solution to a cleaning pad on the cleaning pad mount.

9. The surface cleaning apparatus of claim 6 further comprising a cleaning agent distribution system having a cleaning agent outlet directed at least in front of or behind the surface cleaning head.

10. The surface cleaning apparatus of claim 9 further comprising a controller configured to dispense a cleaning agent from the cleaning agent outlet that is at a leading side of the surface cleaning head based on a direction of travel of the surface cleaning head.

11. The surface cleaning apparatus of claim 6 wherein the water distribution system further comprises an outlet directed at least in front of or behind the surface cleaning head and a controller configured to dispense a water from the outlet that is at a leading side of the surface cleaning head based on a direction of travel of the surface cleaning head.

12. The surface cleaning apparatus of claim 6 wherein the water distribution system is configured to deliver a predetermined amount of water for each stroke of the surface cleaning head.

13. The surface cleaning apparatus of claim 6 wherein the cleaning pad mount is moveably mounted to the surface cleaning head and the surface cleaning head further comprises a drive unit drivingly connected to the cleaning pad mount.

14. The surface cleaning apparatus of claim 13 wherein the drive unit is drivingly connected to the cleaning pad mount to move the cleaning pad mount in a plane that is essentially parallel to a surface to be cleaned.

15. The surface cleaning apparatus of claim 13 wherein the drive unit comprises at least one motor and at least one offset weight.

16. The surface cleaning apparatus of claim 13 wherein the drive unit comprises at least one of a solenoid, a sonic transducer, an ultrasonic transducer and a loudspeaker.

17. The surface cleaning apparatus of claim 6 wherein at least one of the water reservoir, and the heating unit is provided in the surface cleaning head.

18. The surface cleaning apparatus of claim 17 wherein the surface cleaning head has a height less than about 4 inches.

19. The surface cleaning apparatus of claim 6 wherein at least a portion of the water reservoir is transparent.

20. The surface cleaning apparatus of claim 6 further comprising at least one light to illuminate the water reservoir or to illuminate an area in front of the surface cleaning head.

21. The surface cleaning apparatus of claim 6 further comprising at least one light to illuminate the water reservoir and a control system to vary the illumination when the water reservoir reaches a low fluid level.

22. The surface cleaning apparatus of claim 21 wherein the cleaning pad comprises a hydrophobic material and a hydrophilic material.

23. The surface cleaning apparatus of claim 6 wherein the detector monitors the temperature of the heating unit.

24. The surface cleaning apparatus of claim 6 further comprising a cleaning pad, wherein the cleaning pad comprises a hydrophobic material.

25. The surface cleaning apparatus of claim 6 further comprising a second heating unit thermally connected to the cleaning pad mount.

26. The surface cleaning apparatus of claim 6 wherein the first heating unit is thermally connected to the cleaning pad mount.

* * * * *